US011976889B2

(12) United States Patent
Andersen

(10) Patent No.: US 11,976,889 B2
(45) Date of Patent: May 7, 2024

(54) HEAT TRANSFER PLATE AND PLATE HEAT EXCHANGER WITH GASKET GROOVE HAVING A REINFORCING PATTERN

(71) Applicant: Danfoss A/S, Nordborg (DK)

(72) Inventor: Benny Andersen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 195 days.

(21) Appl. No.: 16/695,369

(22) Filed: Nov. 26, 2019

(65) Prior Publication Data

US 2020/0166285 A1 May 28, 2020

(30) Foreign Application Priority Data

Nov. 27, 2018 (DK) ..... PA201800920

(51) Int. Cl.
*F28D 9/00* (2006.01)
*F28F 3/08* (2006.01)

(52) U.S. Cl.
CPC ..... *F28D 9/0093* (2013.01); *F28F 3/08* (2013.01)

(58) Field of Classification Search
CPC ..... F28F 3/10; F28F 2265/16; F28F 2230/00; F28F 2235/00; F28F 2265/26; F28F 3/042; F28F 3/083; F28F 3/08; F28D 9/0031
See application file for complete search history.

(56) References Cited

U.S. PATENT DOCUMENTS 4,781,248 A * 11/1988 Pfeiffer ..... F28F 3/083 165/166
5,193,612 A * 3/1993 Stirnkorb ..... F28F 3/10 165/70
2006/0249282 A1* 11/2006 Song ..... F28F 3/10 165/DIG. 365
2014/0034276 A1* 2/2014 Persson ..... F16J 15/062 165/167
2017/0176047 A1* 6/2017 Kondo ..... B23P 15/26

FOREIGN PATENT DOCUMENTS

CN 1355879 A 6/2002
CN 2864560 Y 1/2007
CN 101124450 A 2/2008
CN 101918784 A 12/2010
(Continued)

OTHER PUBLICATIONS

Heat exchanger (Year: 1987).*
European Search Report for Serial No. EP 19204986.4 dated Apr. 22, 2020.

*Primary Examiner* — Tho V Duong
(74) *Attorney, Agent, or Firm* — McCormick, Paulding & Huber PLLC

(57) ABSTRACT

A plate heat exchanger includes a plurality of heat transfer plates stacked on top of each other, wherein gaskets are positioned between adjacent heat transfer plates, wherein each gasket is arranged in a gasket groove formed in a heat transfer plate and a bottom part of the gasket groove defines a base level, wherein the gasket groove comprises a reinforcing pattern having a first recess at a first recess level and extending in a lengthwise direction of the gasket groove. The reinforcing pattern comprises a second recess at a second recess level extending in lengthwise direction of the gasket groove.

6 Claims, 2 Drawing Sheets

(56) References Cited

FOREIGN PATENT DOCUMENTS

| | | | | | |
|---|---|---|---|---|---|
| CN | 104075609 | A | | 10/2014 | |
| CN | 107270764 | A | | 10/2017 | |
| CN | 206832109 | U | | 1/2018 | |
| DE | 3616746 | A1 | * | 11/1987 | |
| DE | 4303669 | C1 | | 1/1994 | |
| DE | 10029999 | A1 | | 1/2002 | |
| DK | 2626661 | | * | 8/2013 | ..... F28F 3/10 |
| EP | 0604499 | B1 | | 11/1998 | |
| EP | 1722184 | A2 | | 11/2006 | |
| EP | 2626661 | A2 | | 8/2013 | |
| EP | 3 182 048 | A1 | | 6/2017 | |
| GB | 2 164 439 | A | | 3/1986 | |
| GB | 2164439 | | * | 3/1986 | ..... F28F 3/10 |
| JP | H06510848 | A | | 12/1994 | |
| RU | 2527933 | C1 | | 9/2014 | |
| WO | 2009080692 | A1 | | 7/2009 | |

* cited by examiner

HEAT TRANSFER PLATE AND PLATE HEAT EXCHANGER WITH GASKET GROOVE HAVING A REINFORCING PATTERN

CROSS-REFERENCE TO RELATED APPLICATION

This application claims foreign priority benefits under 35 U.S.C. § 119 to Danish Patent Application No. PA201800920 filed on Nov. 27, 2018, the content of which is hereby incorporated by reference in its entirety.

TECHNICAL FIELD

The present invention relates to a plate heat exchanger comprising a plurality of heat transfer plates stacked on top of each other, wherein gaskets are positioned between adjacent plates, wherein each gasket is arranged in a gasket groove formed in a heat transfer plate and a bottom part of the gasket groove defines a base level, wherein the gasket groove comprises a reinforcing pattern having a first recess at a first recess level and extending in a lengthwise direction of the gasket groove.

BACKGROUND

Such a plate heat exchanger is known, for example, from EP 0 604 499 B1.

Such a type of a plate heat exchanger comprises a plurality of heat transfer plates stacked on top of each other. The heat transfer plates are formed with patterns such that flow paths are formed between each set of neighbouring heat transfer plates. Openings are formed in the heat transfer plates to form inlets and outlets for fluids to these flow paths. As a rule, a pair of openings is provided for the primary side of the heat exchanger and another pair of openings is provided for the secondary side of the heat exchanger. Gaskets are positioned between the heat transfer plates. A part of the gasket is used to seal the space between two heat transfer plates to the outside. Another part (or another gasket) is used to seal a region of the openings the primary side from the secondary side. Thus, the gaskets are arranged at an edge portion of the heat transfer plates so seal the flow paths to the outside and at an area around the openings to seal pairs of the openings, such that only two of them have flow access to the flow path formed at one side of the heat transfer plate, while the other two openings are sealed therefrom.

Especially in the opening areas the pressures are high, but the gasket is disposed at only one side of the heat transfer plate, while the other side is unsupported to allow a flow of fluid from the respective opening into the respective flow path. Thus, this part forms a weak section, these weak sections in the areas of the high pressures may be deformed. Further, the gasket tends to be pushed out of position by the pressures in these areas, leading to the risk of a leakage to the outside and to the risk of a leakage between the primary side and the secondary side.

SUMMARY

The object underlying the invention is to make a plate type heat exchanger suitable for high pressures without increasing the risk of leakages.

This object is solved with a plate heat exchanger as described at the outset in that the reinforcing pattern comprises a second recess at a second recess level extending in lengthwise direction of the gasket groove.

The second recess can be used to adapt the reinforcement of the groove caused by the recesses to specific requirements in certain parts of the heat transfer plate.

In an embodiment of the invention the base level is defined by a bottom of the gasket groove in an edge part running along an edge of the heat transfer plate. In the edge part of the groove the recesses are not absolutely necessary, although they can be provided even in the edge part of the groove. The edge part of the groove does define a level, from which the recesses extend.

In an embodiment of the invention the second recess extends in a direction opposite to the first recess from the first recess. In this way the first recess may comprise at least two parallel recessed parts at the first level. In other words, the first recess forms two "rails" in the bottom part of the groove. Accordingly, there are two additional sections of the heat transfer plates running under an angle, preferably perpendicular, to the plane of the heat transfer plate.

In an embodiment of the invention a first portion of the gasket groove surrounds an opening of the heat exchanger plate, wherein the first portion comprises the two parallel recessed parts at the first level. The area around the opening is the area which is subjected to the highest pressure. The recess having the two parallel recessed parts at the first level, i.e. the second recess in opposite direction, gives an excellent reinforcing of the groove.

In an embodiment of the invention the gasket groove comprises a second part running diagonal to an edge portion of the heat transfer plate and being connected to the first portion. The second part can as well be termed "diagonal part". The diagonal part is used alternately, i.e. every second space adjacent to heat transfer plates is filled with a gasket while the diagonal part in the other spaces is not filled with a gasket, so that a fluid connection between the opening and the fluid paths can be established.

In an embodiment of the invention the second portion extends into the edge part. The gasket can continue from the second portion into the edge part.

In an embodiment of the invention the second recess extends downwardly from the first recess. This means that there is a groove having a bottom which is at least twice stacked. This increases the stability of the groove.

In an embodiment of the invention the first recess comprises a first height and the second recess comprises a second height, wherein the first height is different from the second height. This allows a variation of the reinforcement of the gasket groove.

In an embodiment of the invention the heat transfer plate comprises corrugations having troughs and crests, wherein the troughs continue into the gasket groove. This has the advantage, that the gasket, when compressed between two adjacent heat transfer plates, can be squeezed into the troughs which increases the sealing capacity of the gasket and holds the gasket in place.

In an embodiment of the invention at least one of the recesses continues into the troughs. The troughs are likewise reinforced in the area of the recesses.

In an embodiment of the invention the first recess and the second recess extend in different directions from the base level. This means that one recess extends downwardly from the base level and the other recess extends upwardly from the base level.

In an embodiment of the invention the first recess runs along a first section of the gasket groove and the second recess runs along a second section of the gasket groove, wherein the first section is different from the second section. In other words, the two recesses are not arranged in the same section or area of the groove.

In an embodiment of the invention the first section is arranged in one half of the heat transfer plate and the second section is arranged in the other half of the heat transfer plate. This embodiment is in particular advantageous, when adjacent heat transfer plates are stacked on top of each other with inversed orientation. In this case the one half of one heat transfer plate and the second half of another heat transfer plate are positioned above each other giving the possibility to squeeze a gasket between the first recess and the second recess.

In an embodiment of the invention at least one recess reaches into the edge part of a gasket groove. This does not necessarily mean that the recess extends along the whole edge part. However, the recess produces a reinforcement of the transition between the edge part of the gasket groove and another part of the gasket groove.

BRIEF DESCRIPTION OF DRAWINGS

A preferred embodiment of the invention will now be described in more detail with reference to the drawing, wherein.

DETAILED DESCRIPTION

Figure 1:
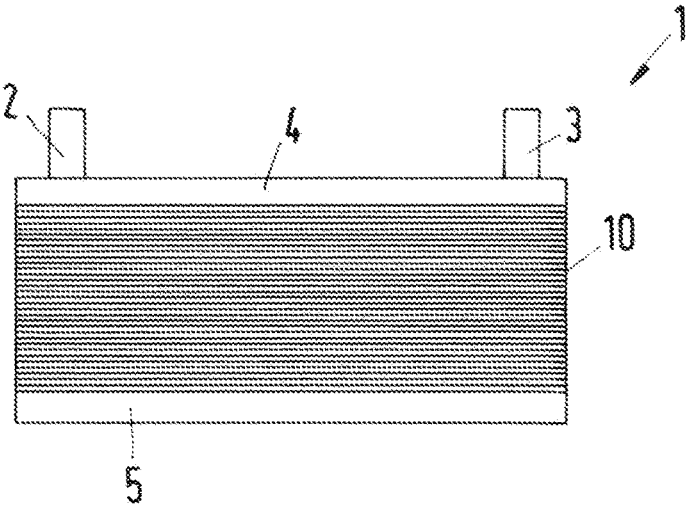
FIG. 1 is a side view of a plate heat exchanger.

FIG. 1 shows schematically a heat exchanger 1 comprising a number of heat transfer plates 10 which are stacked one on top of the other. The stack of heat transfer plates is arranged between a top plate 4 and a bottom plate 5.

The heat exchanger 1 comprises four openings for inlet and outlet of the fluids. Two openings 2, 3 which are shown in FIG. 1 are used for the fluid passing the primary side of the heat exchanger 1. Two other openings 6, 7 (FIG. 2 only) are used for inlet and outlet of the fluid passing the secondary side of the heat exchanger.

Figure 2:
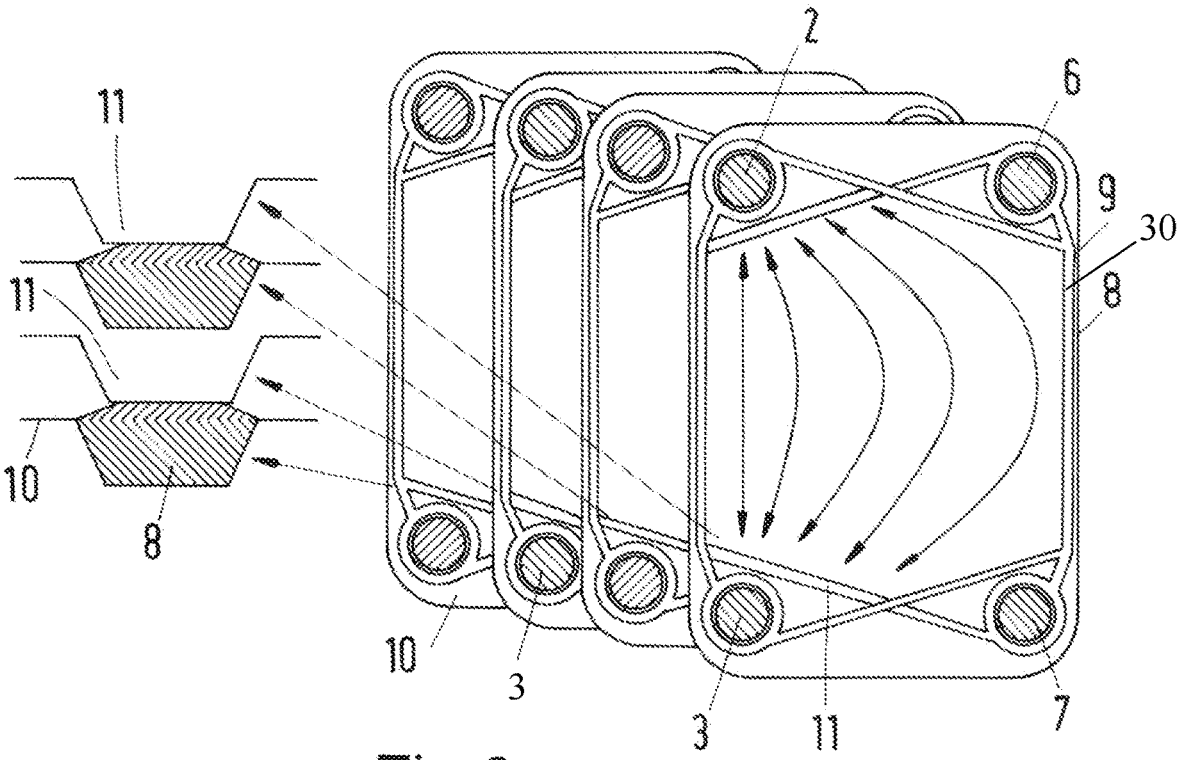
FIG. 2 is a top view of a stack of heat transfer plates.

FIG. 2 schematically shows a stack of four heat transfer plates 10. The heat transfer plates 10 are laterally offset to each other in order to show some details.

Each heat transfer plate 10 is provided with a gasket 8. The gasket 8 in all heat transfer plates runs along an edge 9 of the heat transfer plates. However, in a half of the number of the heat transfer plates 10 the gasket 8 leaves open a connection between the openings 2, 3 and an interior of the space between two adjacent plates for the primary side and (which is not visible in FIG. 2) in the other half, i.e. in every second plate the gasket 8 leaves open a connection between the openings 6, 7 and the interior of the space between adjacent plates 10 to allow a flow of fluid through the secondary side of the heat exchanger.

The gasket 8 is mounted in a groove.

As can be seen in FIG. 2, each heat transfer plate 10 comprises a part 11 of the groove, which is not filled by the gasket. Accordingly, the bottom of the part 11 of the groove which is free of the gasket 8 is not supported against a pressure acting between adjacent heat transfer plates. This can lead to a deformation of the heat transfer plate in the region of the part 11 of the groove with a resulting leakage. It can also lead to the effect that the gasket 8 is pushed out of position by the pressure in these areas.

Figure 3:
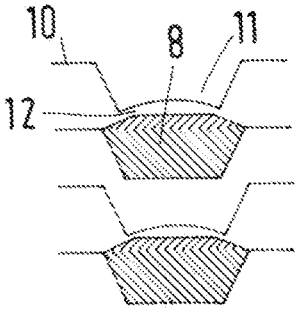
FIG. 3 shows the problem in an area surrounding an opening of a heat transfer plate.

This effect is schematically shown in FIG. 3 in which a gap 12 has appeared between the gasket 8 and the bottom side of the bottom of the part 11 of the groove of the next plate 10 above the gasket 8.

Figure 4:
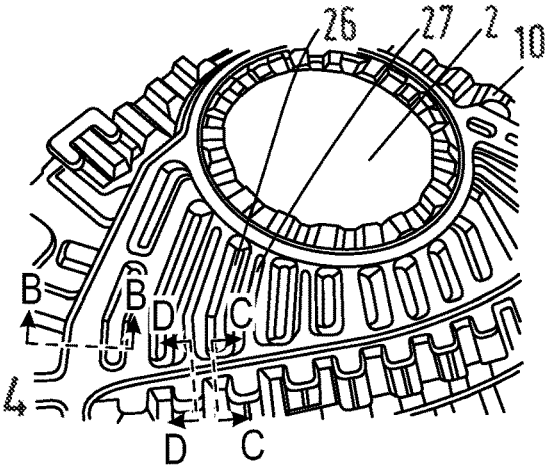
FIG. 4 shows a heat transfer plate from the underside.

To overcome this problem, the heat transfer plate 10 of the heat exchanger 1 is provided with a reinforced gasket groove 20 which is shown in several sectional views in FIG. 5. The sections are taken from a heat transfer plate 10 shown in FIG. 4. FIG. 4 shows the heat transfer plate 10 from the underside.

Figure 5A:
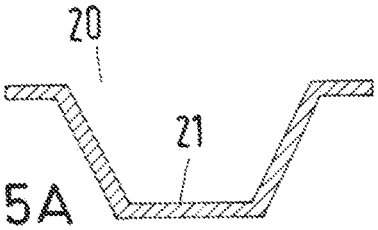
FIG. 5A shows a groove in an area running along an edge, shown in FIG. 2.

FIG. 5A shows the reinforced gasket groove 20 in an area running along the edge 9.

The reinforced gasket groove 20 comprises a bottom 21 which defines a base level. The base level 22 is shown in FIG. 5B to 5D with a dotted line.

Figure 5B:
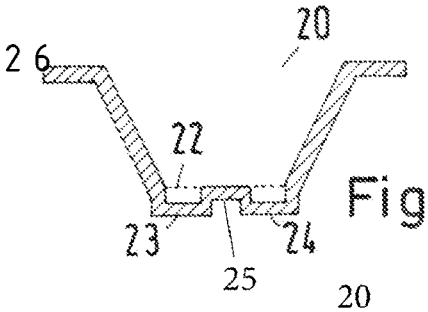
FIG. 5B shows a section along line B according to FIG. 4.

As can be seen in FIG. 5B, showing a section along line B according to FIG. 4, reinforced gasket groove 20 comprises a first recess comprising two parallel recessed parts 23, 24. These recessed parts 23, 24 have a first recess level which is below the base level 22. The recessed parts 23, 24 are separated by a second recess 25 extending from the bottom of the first recess in opposite direction to the first recess.

Figure 5C:
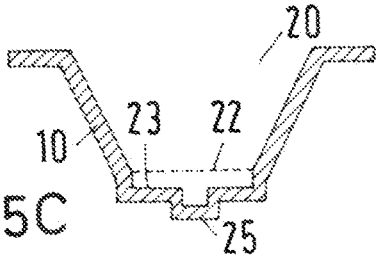
FIG. 5C shows a section along line C of FIG. 4.
Figure 5D:
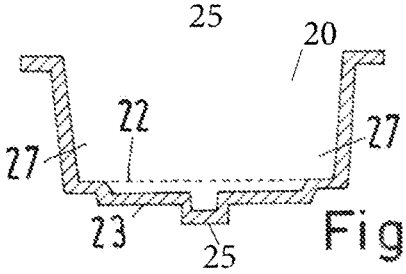
FIG. 5D shows a sectional view along line D in FIG. 4.

FIG. 5C shows a section along line C of FIG. 4 and shows a first recess 23 at a first recess level below the base level 22 and a second recess 25 at a second recess level below the first recess level of the first recess 23.

The first recess 23, 24 and the second recess 25 run along the lengthwise direction of the reinforced gasket groove 20.

FIG. 5D shows a sectional view along line D in FIG. 4.

It can be seen in FIG. 4 that the heat transfer plate 10 comprises corrugations having crests 26 and troughs 27. It should be noted that FIG. 4 shows the heat transfer plate 10 from the bottom so that crests 26 and troughs 27 appear to be inverted.

The reinforced gasket groove 20 extends into the crests 26 and the first recess 23 extends into the troughs 27 as well.

As can be seen, in particular in FIG. 4, a gasket groove 20 surrounds an opening 2 of the heat transfer plate 10, wherein the form of the gasket groove 20 in this area is shown in FIG. 5B, i.e. the gasket groove 20 comprises two first recesses 23, 24 extending below the base level 22 to the first recess level.

Figure 6:
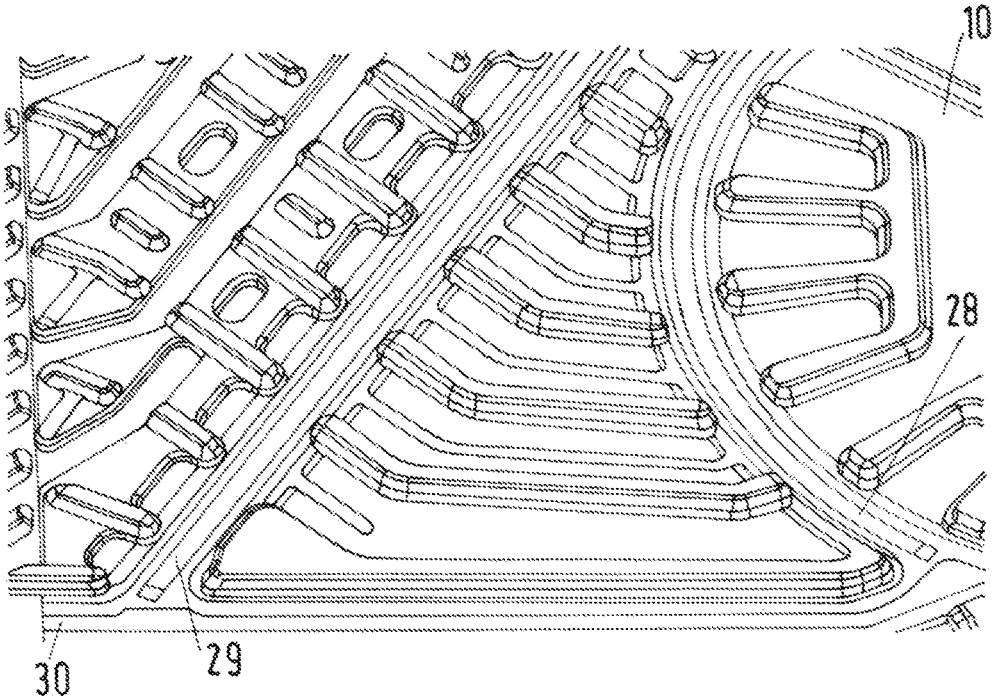
FIG. 6 shows a bottom view of another heat transfer plate.

FIG. 6 shows a slightly modified heat transfer plate 10 from the bottom, in which the gasket groove 20 comprises the ring-shaped part 28 surrounding the opening 2 and a diagonal part 29. The diagonal part 29 extends into an edge part 30 of the groove. A first recess 23 extends at least partly as well in the edge part 30 of the groove.

As can be seen in FIG. 5C, the first recess 23 comprises a first height and the second recess comprises a second height. The first height is different from the second height. In the example shown in FIG. 5C the second height is smaller than the first height. However, it is also possible that the first height is smaller than the second height.

As shown in the figures, it is also possible that the first recess 23 extends downwardly from the base level 22 in a first section of the gasket groove 20. This is shown in FIG. 5B to 5D. In a way not shown, the second section of the gasket groove 20 can have a second recess extending upwardly from the base level 22. When heat transfer plates 10 are stacked above each other, then a gasket 8 arranged in a gasket groove 20 is compressed more intensively, since the space available for the gasket 8, more precisely the height, has been decreased.

This is in particular the case, when the first section is arranged in one half of the heat transfer plate 10 and the second section is arranged in the other half of the heat transfer plate 10 and every second heat transfer plate 10 is rotated by 180° before stacking it to the previous plate 10.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A plate heat exchanger comprising a plurality of heat transfer plates stacked on top of each other, wherein gaskets are positioned between adjacent heat transfer plates, wherein each gasket is arranged in a gasket groove formed in a heat transfer plate of the adjacent heat transfer plates and a bottom part of the gasket groove in a part running along an edge of the heat transfer plate defines a base level, wherein the gasket groove comprises a reinforcing pattern having a first recess having a bottom part at a first recessed level relative to the bottom part defining the base level and extending in a lengthwise direction of the gasket groove, wherein the reinforcing pattern comprises a second recess having a bottom part at a second recessed level relative to the bottom part defining the base level extending in the lengthwise direction of the gasket groove, wherein the first recessed level is at a different height relative to the base level than the second recessed level, wherein the gasket is compressed between the first and second recesses and one of the adjacent heat transfer plates, and wherein the second recess extends from the first recess in a same direction as a direction the first recess extends from the base level.

2. The plate heat exchanger according to claim 1, wherein a first portion of the gasket groove surrounds an opening of the heat transfer plate, wherein the first portion comprises two parallel recessed parts at the first recessed level.

3. The plate heat exchanger according to claim 1, wherein the gasket groove comprises a second part running diagonal to the part running along the edge of the heat transfer plate and being connected to the first portion.

4. The plate heat exchanger according to claim 3, wherein the second part extends into the part running along the edge of the heat transfer plate.

5. The plate heat exchanger according to claim 1, wherein at least one recess extends into a part of the gasket groove running along an edge of the heat transfer plate.

6. A heat transfer plate for a plate heat exchanger having a plurality heat transfer plates, the heat transfer plate comprising a gasket groove formed in the heat transfer plate, wherein a bottom part of the gasket groove in a part running along an edge of the heat transfer plate defines a base level, wherein the gasket groove comprises a reinforcing pattern having a first recess having a bottom part at a first recessed level relative to the bottom part defining the base level and extending in a lengthwise direction of the gasket groove, wherein the reinforcing pattern comprises a second recess having a bottom part at a second recessed level relative to the bottom part defining the base level and extending in the lengthwise direction of the gasket groove, wherein the second recess extends from the first recess, wherein the first recessed level is at a different height relative to the base level than the second recessed level, wherein the gasket is compressed between the first and second recesses and one of the adjacent heat transfer plates, and wherein the second recess extends from the first recess in a same direction as a direction the first recess extends from the base level.

* * * * *